United States Patent [19]

Oster

[11] Patent Number: 4,975,553

[45] Date of Patent: Dec. 4, 1990

[54] LINE TERMINAL AND ARC STACK FOR A CIRCUIT BREAKER

[75] Inventor: Clark L. Oster, Cedar Rapids, Iowa

[73] Assignee: Square D Company, Palatine, Ill.

[21] Appl. No.: 313,698

[22] Filed: Feb. 22, 1989

[51] Int. Cl.[5] ..... H01H 33/18; H01H 33/20

[52] U.S. Cl. ..... 200/147 R; 200/144 R

[58] Field of Search ..... 200/144 R, 147 R, 146 R

[56] References Cited

U.S. PATENT DOCUMENTS 4,086,460 4/1978 Gillette ..... 200/146 R 4,618,751 10/1986 Wehr et al. ..... 200/147 R

*Primary Examiner*—Robert S. Macon

*Attorney, Agent, or Firm*—Jose W. Jimenez; Larry I. Golden

[57] ABSTRACT

A circuit breaker line terminal includes a uniform width, flat, sheet metal body having end portions for coupling to a line conductor and an arc runner, respectively. An integral tongue has an end forming a return loop spaced from the body and includes a lanced out portion that carries a contact. The contact may be supported through the opening formed by lancing the body.

15 Claims, 4 Drawing Sheets

LINE TERMINAL AND ARC STACK FOR A CIRCUIT BREAKER

DESCRIPTION

1. Technical Field

The invention relates to a circuit breaker and, more particularly, to an efficient construction of a line terminal and an arc stack for a circuit breaker.

2. Background Prior Art

Circuit breakers are utilized to break an electrical circuit in the event of an over-current condition. Such circuit breakers typically have a stationary contact and a movable contact. The movable contact is attached to a blade which moves the moveable contact between a contacting and a noncontacting relationship with the stationary contact, thereby resultingly closing and opening the circuit.

Typically the movable contact is coupled to a load connector by means of the blade and a load terminal, the load connector adapted being for ultimate connection to a load. The stationary contact is coupled to a line connector by a line terminal, the line connector being adapted for ultimate connection to a source of power.

If the circuit is opened when current is flowing between the stationary and movable contacts, an arc is created. This arc releases relatively large amounts of energy as heat and is therefore detrimental to the circuit breaker. Thus circuit breakers typically have mechanisms to minimize the arcing.

One such mechanism incorporates a line terminal which loops back on itself to increase an electromagnetic repulsive force to more quickly move the blade, and hence the moveable contact, away from the stationary contact, to more quickly break the arc. However because a line terminal must be sufficiently wide at one end to accommodate a line connector such prior line terminals, have been wasteful of material. Further such line terminals have had to rely on other fabricated parts to properly locate the stationary contact in the circuit breaker.

Further, the prior line terminals had an attached steel plate to act as an arc runner to transfer the arc to an arc stack. Attaching the steel plate to the line terminal required an additional manufacturing step as well as additional material.

In addition the arc stacks themselves employed complex geometries which made assembly difficult, especially to automate. Also, the arc stacks were mounted in the circuit breaker case separately from the line terminal with which it was to cooperate, again making assembly difficult.

The present invention is provided to solve these and other problems.

SUMMARY OF THE INVENTION

It is an object of the invention to provide an efficient line terminal construction, an efficient arc stack construction and an efficient line terminal and arc stack assembly.

In accordance with one aspect of the invention, a line terminal for a circuit breaker is provided.

The line terminal comprises a body portion having first and second longitudinal end portions. The first longitudinal end portion is adapted for coupling to a line conductor.

The line terminal further includes a tongue integral with the body portion substantially at the second end portion to form a return loop spaced from the body portion. The tongue embodies a portion lanced and upwardly formed from the body portion.

It is comprehended that the tongue is directed substantially toward the first longitudinal end.

It is further comprehended that the body is of substantially uniform width.

It is still further comprehended that the tongue is generally L-shaped and includes a first segment joined with the body portion and directed substantially perpendicular to the body portion, and a second segment joined with the first segment and directed substantially parallel to the body portion.

In accordance with another aspect of the invention, an arc stack adapted for placement in an arc chamber of a molded case circuit breaker is provided.

The arc stack comprises first and second spaced support plates having a plurality of mutually corresponding slots and a corresponding plurality of generally U-shaped arc plates.

Each of the arc plates has a center void defining spaced first and second leg portions. Each of the leg portions has first and second outwardly directed, generally L-shaped tab portions. Each of the first tab portions defines a notch, and each of the second tab portions defines a depression. One of the plurality of the arc plates is disposed in each of the mutually corresponding slots. The pair of notches and depressions of each of the arc plates cooperate with the respective ones of the support plate slots to provide an interference fit between each of the plates and its respective support plate slots.

It is comprehended that each of the arc plates is angularly oriented with respect to the arc chamber.

It is further comprehended that the arc plates are parallel to one another.

It is yet further comprehended that at least one of the first leg portions includes means extending outwardly from the first support plate, and at least one of the second leg portions includes means extending outwardly from the second support plate. The outwardly extending means cooperate with the arc chamber for aligning the arc stack in the arc chamber.

In still another aspect of the invention, a line terminal and arc stack assembly for a molded case circuit breaker is provided. .

The case has a base and a cover, the base and the cover including partitions defining an arc chamber.

The line terminal and arc stack assembly includes a line terminal comprising an incoming loop portion and a return loop portion. The return loop portion is spaced from the loop incoming loop portion.

The line terminal and arc stack assembly further includes an arc stack adapted for placement in the arc chamber. The arc stack includes first and second spaced support plates having a plurality of mutually corresponding slots and a corresponding plurality of spaced, generally U-shaped arc plates.

Each of the arc plates has a center void defining opposing first and second leg portions. One of the plurality of plates is disposed in each of the mutually corresponding slots, the first and second leg portions including means for cooperating with the respective ones of the support plate slots to provide an interference fit between each of the plates and its respective support plate slots.

The line terminal is adapted to bear on the base portion, and a bottom one of the arc plates of the arc stack is adapted to bear on the return loop portion to support the arc stack. An upper portion of the arc stack is adapted to contact the cover to maintain the bottom plate of the arc stack in contact with the return loop portion.

Other features and advantages of the invention will be apparent from the following specification taken in conjunction with the following drawing.

DETAILED DESCRIPTION

Figure 1:
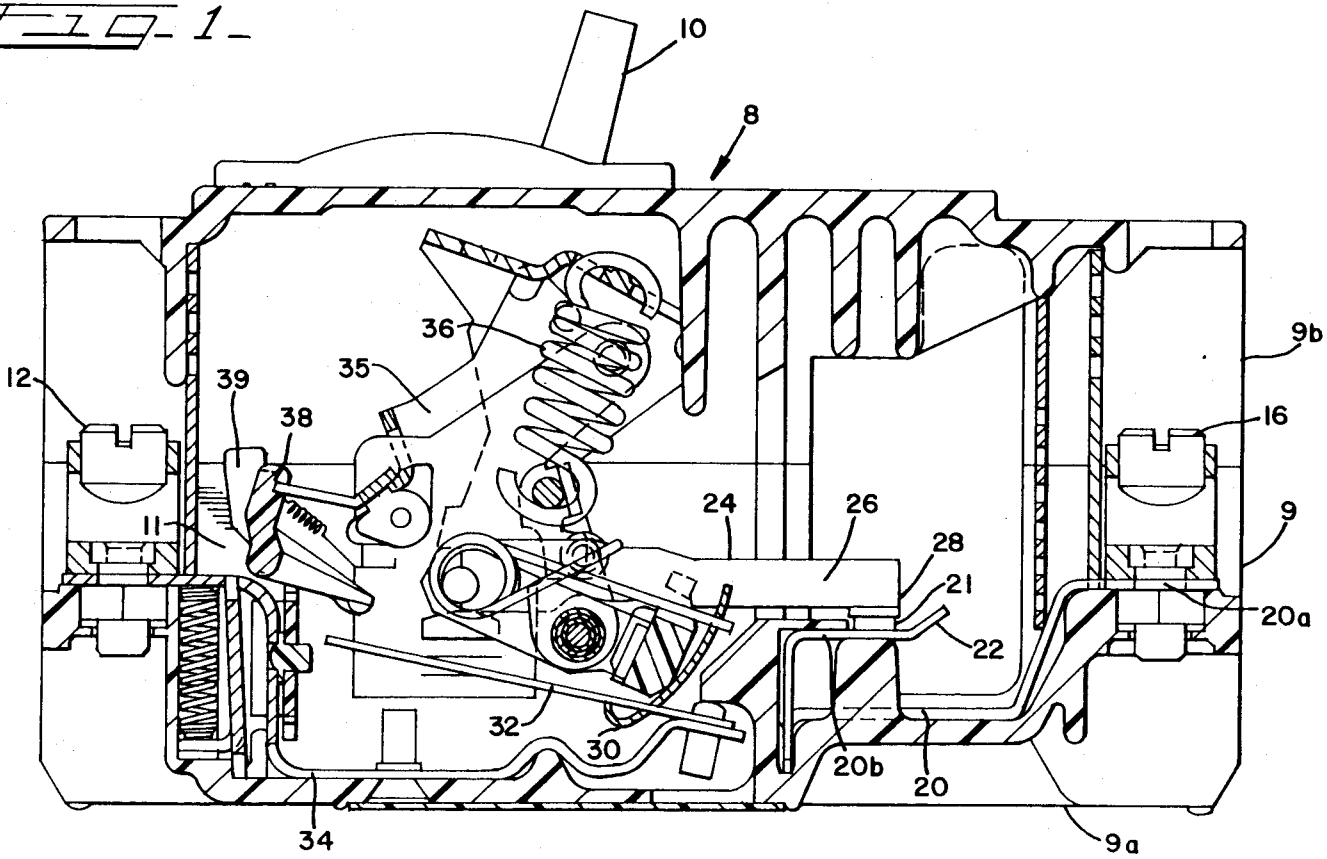
FIG. 1 is a sectional view of a circuit breaker according to the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A circuit breaker generally designated 8 is illustrated FIG. 1. The, circuit breaker 8 may be a single pole circuit breaker, a three pole circuit breaker, or a circuit breaker including any number of poles, as required.

The general structure and operation of a circuit breaker is detailed in Leonard, U.S. Pat. No. 3,341,791, the specification of which is expressly incorporated herein by reference.

The circuit breaker 8 includes a supporting structure comprising a two-part case 9 having a base **9*a* and a cover 9*b*, and an operating handle 10, all preferably molded of an insulating material. Internal partition walls 11** separate respective phase chambers, as is well known in the art.

The circuit breaker 8 includes a load connector 12 adapted to be coupled to an electrical load (not shown) and a line connector 16 adapted to be coupled to an electrical supply (not shown).

The circuit breaker 8 further includes a line terminal 20 having a terminal end **20*a* coupled to the line connector 16, and a stationary contact end 20*b*. A stationary contact 21 is brazed to the stationary contact end 20*b*. The stationary contact end 20*b* terminates at an integral arc runner portion 22**.

The circuit breaker 8 further includes a contact carrier, or blade, 24 having a pivoting end 26 and a movable contact 28. A pigtail 30 is coupled between the pivoting end 26 of the blade 24 and a bimetallic thermal element 32. A load terminal 34 couples the bimetallic thermal element 32 to the load connector 12.

When the blade 24 is in contact with the line terminal the 20 (stationary contact 21 and movable contact 28 are mated), the circuit breaker 8 is in a "closed" position, and current is permitted to flow between the line connector 16 and the load connector 12. Correspondingly when the blade 24 is not in contact with the line terminal 20 (stationary contact 21 and movable contact 28 are separated), the circuit breaker 8 is in an "open" position, and current is prevented from flowing between the line connector 16 and the load connector 12.

In operation when the circuit breaker 8 is in the closed position, electrical current flows sequentially through the line connector 16, the line terminal 20, the stationary contact end **20*b*, the stationary contact 21, the movable contact 28, the blade 24, the pigtail 30, the thermal element 32, the load terminal 34, and ultimately through the load connector 12** to the load.

The circuit breaker 8 further includes a conventional latching mechanism 35, a more detailed description of which is contained in the above incorporated Leonard patent.

A bias spring 36 biases the blade 24 away from the stationary contact 21, towards the open position. The latching mechanism 35 opposes the bias spring 36 to releasably maintain the circuit breaker 8 in the closed position. A trip crossbar 38 extends laterally across the circuit breaker 8 and is supported by openings 39 in the partition walls 11 of the base **9*a* and the cover 9*b* of the case 9. As discussed below, when the thermal element 32 deforms sufficiently as a result of overheating during an overcurrent condition, the thermal element 32 operates to rotate the trip crossbar 38, releasing the latching mechanism 35. Release of the latching mechanism 35 causes the bias spring 36 to move the blade 24** to the open position.

Actuation of the operating handle 10 can also cause the blade 24 to move to the open position.

The phase chamber surrounding the stationary contact 21 is referred to as an arc chamber, as an arc is created between the stationary contact 21 and the movable contact 28 when the circuit breaker 8 goes from the closed position to the open position, and the electrical circuit is broken. The arc can release substantial energy and therefore, the arc must be quickly extinguished to prevent damage to the circuit breaker 8.

Figure 2:
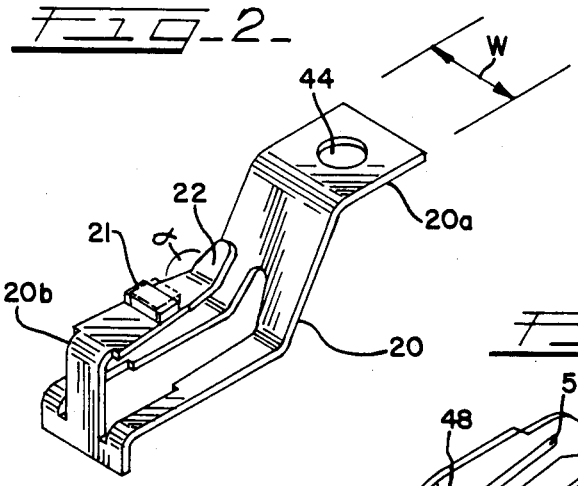
FIG. 2 is an isometric view of a line terminal according to the invention.

Referring now to FIG. 2, the line terminal 20 is illustrated. The line terminal 20 is formed from a single piece of stock having a uniform width "W". The line terminal 20 includes a hole 44 adapted for receiving the line connector 16 (FIG. 1).

The stationary contact end **20*b* is formed by lancing, or otherwise cutting away, a center portion of the stock. The cut away portion is then upwardly bent, as illustrated. The stationary contact 21 is then brazed to the stationary contact end 20*b*. The lower portion of the line terminal 20** is referred to as the "incoming loop" and the upper portion is referred to as the "return loop".

The return loop terminates at the arc runner 22 which is at an angle "alpha" with respect to the balance of the return loop.

Figure 3:
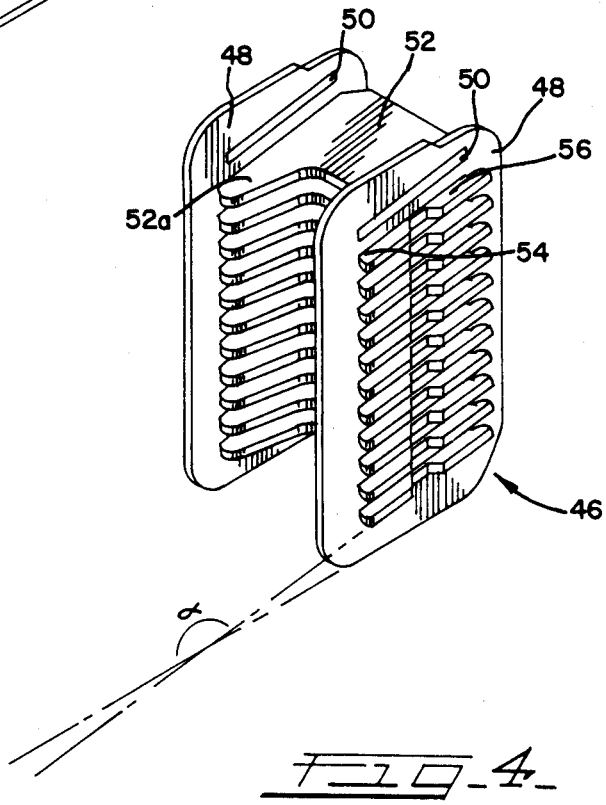
FIG. 3 is an isometric view of an arc stack according to the invention.

An arc stack 46 is illustrated in FIG. 3.

The arc stack 46 includes a pair of spaced support plates 48, each having a plurality of preferably parallel slots 50 and a plurality of arc plates 52 supported therein. The arc plates 52 are preferably U-shaped and have leg portions **52*a*, 52*b*, each terminating with first and second tabs 54, 56** respectively.

Figure 4:
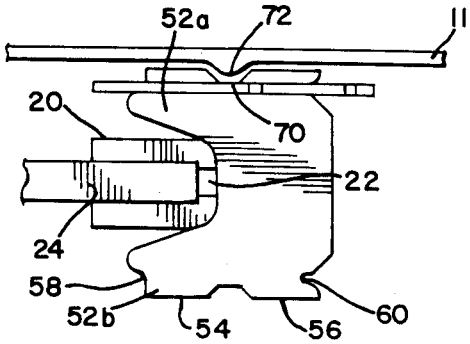
FIG. 4 is a plan view of the arc stack of FIG. 3.

As illustrated in FIG. 4, the first tab 54 forms a small depression generally designated 58 with respect to the leg **52*b* and the second tab 56 forms a notch generally designated 60 with respect to the leg 52*b***.

The arc stack 46 is assembled by placing the second tab 56 into the slot 50 and sliding the first tab 54 into the slot 50. The support plate 48 is resilient to permit the first tab 54 to snap into the slot 50, forming an interference fit to retain the arc plate 52 in the slot 50. This procedure is performed for both legs 52*a* and 52*b* of each of the arc plates 52. When complete, the arc stack 46 will be self supporting.

To facilitate automated assembly of the arc stack 46, the slots 50, and hence the arc plates 52, are preferably parallel to one another.

For reasons discussed below, the slots 50, and hence the arc plates 52, are also at an angle "alpha" with respect to the support plate 48.

Figure 5:
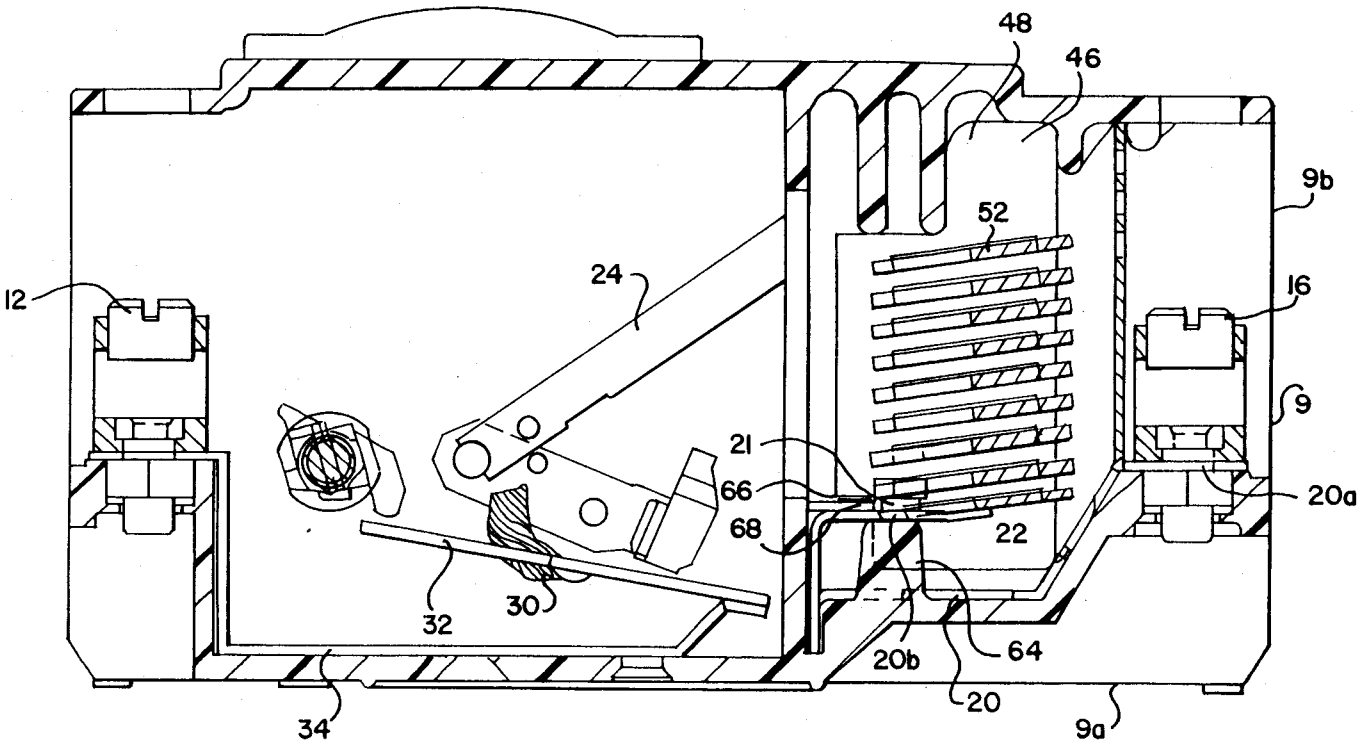
FIG. 5 is a cross section of the circuit breaker of FIG. 1 with certain elements removed for clarity.

The arc stack 46 and the line terminal 20 disposed in the circuit breaker 8 are illustrated in FIG. 5.

The line terminal 20 rests on the base 9*a* of the case 9. The stationary contact end 20*b* rests on a post 64 extending upwardly from the base 9*a* and through the lanced opening of the line terminal 20. The post 64 both properly locates the line terminal 20 on the base 9*a* and provides support for the stationary contact end 20*b* when the blade 24 is pushing downward on the stationary contact end 20*b*. Thus, the line terminal 20 does not need to withstand the force of the blade 24.

The arc stack 46 is placed over the line terminal 20, with the bottom one of the arc plates 52 resting on the arc runner portion 22. The support plates 48 also include a notch 66 which rests on a ledge 68 of the base 9*a*.

When the cover 9*b* is placed over the base 9*a*, the cover 9*b* bears downward against the support plates 48 of the arc stack 46, maintaining the bottom one of the arc plates 52 in contact with the arc runner portion 22.

In operation, as the blade 24 moves the movable contact 28 away from the stationary contact 21, an arc is formed. The electromagnetic force caused by current passing through the blade 24 and the return loop portion of the line terminal 20 forces the arc away from the stationary contact 21 to the right with respect to FIG. 5 into the arc stack 46.

The arc passing from the arc runner portion 22 to the bottom one of the arc plates 52 will weld the arc runner portion 22 to the lower one of the arc plates 52. Thus, one obtains a welded joint between the arc runner portion 22 and the bottom one of the arc plates 52 without a need for making the weld or other connection during the manufacturing of the circuit breaker 8.

Referring again to FIG. 4, the tabs 54 and 56 form a groove 70 which cooperates with a ridge 72 in the partition wall 11 to accurately locate the arc stack 46 within the arc chamber.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A line terminal for a circuit breaker comprising:

a sheet metal body portion having first and second longitudinal end portions, said first longitudinal end portion adapted for coupling to a line conductor and said second longitudinal end portion forming an arc runner;

a tongue integral with said body portion substantially at said second longitudinal end portion to form a return loop spaced from said body portion, said tongue embodying a portion lanced and upwardly formed from said body portion leaving an opening in said body portion;

a contact carried on said tongue; and means in said tongue for enabling support to be provided for said contact through said opening.

2. The line terminal of claim 1 wherein said tongue is directed substantially toward said first longitudinal end portion.

3. The line terminal of claim 2 wherein said body portion is of substantially uniform width.

4. The line terminal of claim 3 wherein said tongue is generally L-shaped and includes a first segment joined with said body portion and directed substantially perpendicular to said body portion, and a second segment joined with said first segment and directed substantially parallel to said body portion.

5. The line terminal of claim 4 including a contact brazed to said tongue.

6. An arc stack adapted for placement in an arc chamber of a molded case circuit breaker, the arc stack comprising:

first and second spaced support plates having a plurality of mutually corresponding slots; and a corresponding plurality of arc plates, each of said arc plates having first and second outwardly directed, generally L-shaped tab portions, each of said first tab portions defining a notch and each of said second tab portions defining a depression, wherein one of said plurality of plates are disposed in each of said mutually corresponding slots, said pair of notches and depressions of each of said plates cooperating with said respective ones of said support plate slots to provide an interference fit between each of said plates and its respective support plate slots.

7. The arc stack of claim 6 wherein each of said arc plates is angularly oriented with respect to said arc chamber.

8. The arc stack of claim 6 wherein said arc plates are parallel to one another.

9. The arc stack of claim 6 wherein said arc plates are parallel to one another and angularly oriented with respect to said arc chamber.

10. The arc stack of claim 6 wherein at least one of said leg portions extends outwardly from said first support plate and at least one of said leg portions extends outwardly from said second support plate for cooperating with said arc chamber for aligning said arc stack in said arc chamber.

11. The arc stack of claim 10 wherein said cooperating means comprises a pair of grooves, one of said grooves formed by a pair of tab portions outwardly extending from at least one of said first leg portions and the other one of said grooves formed by a pair of tab portions outwardly extending from at least one of said second leg portions, said grooves adapted to cooperate with a ridge on said respective walls of said arc chamber.

12. The arc stack of claim 6 wherein each of said arc plates are generally U-shaped having a center void defining first and second leg portions.

13. A line terminal assembly for a circuit breaker comprising:

a molded case having a base and a cover, said base and said cover including partitions defining an arc chamber;

a post in said arc chamber upwardly directed from said base substantially toward said cover;

a line terminal comprising a body portion having first and second longitudinal end portions to form an incoming loop portion, said first longitudinal end portion adapted for coupling to a line conductor, and a tongue integral with said body portion substantially at said second end portion to form a return loop spaced from said body portion, said tongue embodying a portion lanced and upwardly formed from said body, said lanced portion resulting in a void in said incoming loop portion wherein said post is disposed through said void and in contact with said return loop portion to locate said line terminal and support said return loop portion.

14. A line terminal and arc stack assembly comprising:

a molded case having a base and a cover, said base and said cover including partitions defining an arc chamber;

a line terminal comprising an incoming loop and a return loop, said return loop spaced from said incoming loop;

an arc stack adapted for placement in said arc chamber including first and second spaced support plates having a plurality of mutually corresponding slots, and a corresponding plurality of spaced, generally U-shaped arc plates, each of said arc plates having a center void defining spaced first and second leg portions, wherein one of said plurality of arc plates is disposed in each of said mutually corresponding slots, said first and second leg portions including means for cooperating with said respective ones of said support plate slots to provide an interference fit between each of said support plates and its respective slots, wherein said line terminal is adapted to bear on said base portion, a bottom one of said arc stack is adapted to bear on said return loop to support said arc stack and an upper portion of said arc stack is adapted to contact said cover to maintain said bottom plate in contact with said return loop.

15. A line terminal and arc stack assembly comprising:

a molded case having a base and a cover, said base and said cover including partitions defining an arc chamber;

a post in said arc chamber upwardly directed from said base substantially toward said cover;

a line terminal comprising a body portion having first and second longitudinal end portions to form an incoming loop portion, said first longitudinal end portion adapted for coupling to a line conductor, and a tongue integral with said body portion substantially at said second end portion to form a return loop spaced from said body portion, said tongue embodying a portion lanced and upwardly formed from said body portion, said lanced portion resulting in a void in said incoming loop portion, wherein said post is disposed through said void and in contact with said return loop portion to support said return loop portion, and an arc stack adapted for placement in said arc chamber including first and second spaced support plates having a plurality of mutually corresponding slots, and a corresponding plurality of spaced, generally U-shaped arc plates, each of said arc plates having a center void defining opposing first and second leg portions, each of said leg portions having first and second outwardly directed, generally L-shaped tab portions, each of said first tab portions defining a notch and each of said second tab portions defining a depression, wherein one of said plurality of plates are disposed in each of said mutually corresponding slots, said pair of notches and depressions of each of said plates cooperating with said respective ones of said support plate slots to provide an interference fit between each of said plates and its respective support plate slots, wherein said line terminal is adapted to bear on said base portion, said lower plate of said arc stack is adapted to bear on said return loop portion to support said arc stack and said arc stack is adapted to contact said cover to maintain said lower plate in contact with said return portion.

* * * * *